United States Patent [19]

Bentler

[11] 4,353,464

[45] Oct. 12, 1982

[54] BICYCLE STORAGE AND TRAVEL CASE

[76] Inventor: James S. Bentler, 105 E. Toledo St., Duluth, Minn. 55811

[21] Appl. No.: 257,513

[22] Filed: Apr. 27, 1981

[51] Int. Cl.[3] ..... B65D 85/68

[52] U.S. Cl. ..... 206/335; 206/523; 206/303; 206/446; 206/592; 206/564; 206/391; 217/37

[58] Field of Search ..... 206/523, 335, 303, 446, 206/592, 564, 391; 217/37, 38

[56] References Cited

U.S. PATENT DOCUMENTS

| | | | |
|---|---|---|---|
| 478,954 | 7/1892 | Davis | 206/335 |
| 2,339,947 | 1/1944 | Reaume | 206/335 |
| 3,871,546 | 3/1975 | Thompson | 206/335 |
| 3,886,988 | 6/1975 | Garrett et al. | 206/335 |
| 4,149,634 | 4/1979 | Lewis et al. | 206/335 |

*Primary Examiner*—Joseph Man-Fu Moy

[57] ABSTRACT

A container for the storage and transport of a bicycle, partially disassembled, having a hinged cover and multi-level contours for storing bicycle components in relative spatial isolation.

15 Claims, 4 Drawing Figures

BICYCLE STORAGE AND TRAVEL CASE

BACKGROUND OF THE INVENTION

The present invention relates to a container and case for the storage and transport of a bicycle. More particularly, the invention relates to a container for storage and transport of a bicycle in partial disassembly.

In recent years, the popularization of lightweight bicycles has greatly increased sport and competitive usage of such machines, particularly bicycles especially designed with extremely lightweight frames and other components and intended for long distance riding. Such machines are constructed of lightweight metals and are precision machined and balanced to provide maximum speed and range with minimum weight. Such machines are commonly provided with derailleur multi-speed mechanisms.

Unfortunately, as the weight of modern bicycles is reduced, and the precision machining features are increased, the bicycle mechanism becomes more fragile and susceptible to damage from abusive handling. Lightweight wheels and rims are susceptible to bending, and derailleur mechanisms are susceptible to misalignment.

Bicycle touring has also become popularized in recent years. One aspect of this sport involves the long distance touring of groups of bicyclists in places remote from their homes. Typically, the bicyclist transports himself and his machine to a remote starting point by auto, train, bus or airplane and engages in the sport of touring in regions at the remote location. At the completion of such touring events the bicyclist and his machine are transported back to their home location.

In the normal and other usage of a modern lightweight bicycle great care must be taken for the storage and transport of the machine to avoid damage or destruction to the machine. Since machines of such precision have become extremely expensive and difficult to repair, a need has arisen for a container device which can safely store and transport a bicycle, even under the abusive handling conditions typically found in commercial airline service. Such a container must be more than a mere box for enclosing the bicycle, for it must be as compact as possible to conserve space during shipping, and it must protect the components of the bicycle from wear and damage by contacting other bicycle components.

SUMMARY OF THE INVENTION

The present invention provides a container for the storage of a bicycle, for providing complete protection of the bicycle from outside handling and abuse. Further, the invention comprises a unique internal contour having multi-level recesses for seating individual bicycle components in overlapped but isolated and protected relationship. The container provides for partial disassembly of a bicycle, but permits storage in assembled form of components which are precisely aligned. Such storage eliminates the necessity for realignment of precision components after removing the bicycle from the container and reassembling it.

It is therefore a principal object of the invention to provide a container for the storage and transport of a partially disassembled bicycle, protecting all of the bicycle components.

It is a further object of the invention to provide a carrying case for a bicycle which is strong and lightweight, and may be utilized as a shipping container. It is another object of the invention to provide a bicycle storage and transport container which will accept and safely store many different sizes of bicycles.

BRIEF DESCRIPTION OF THE DRAWINGS

The foregoing objects and other objects and advantages of the invention will become apparent from the appended specification, and with reference to the drawings, in which.

DESCRIPTION OF THE PREFERRED EMBODIMENT

Figure 1:
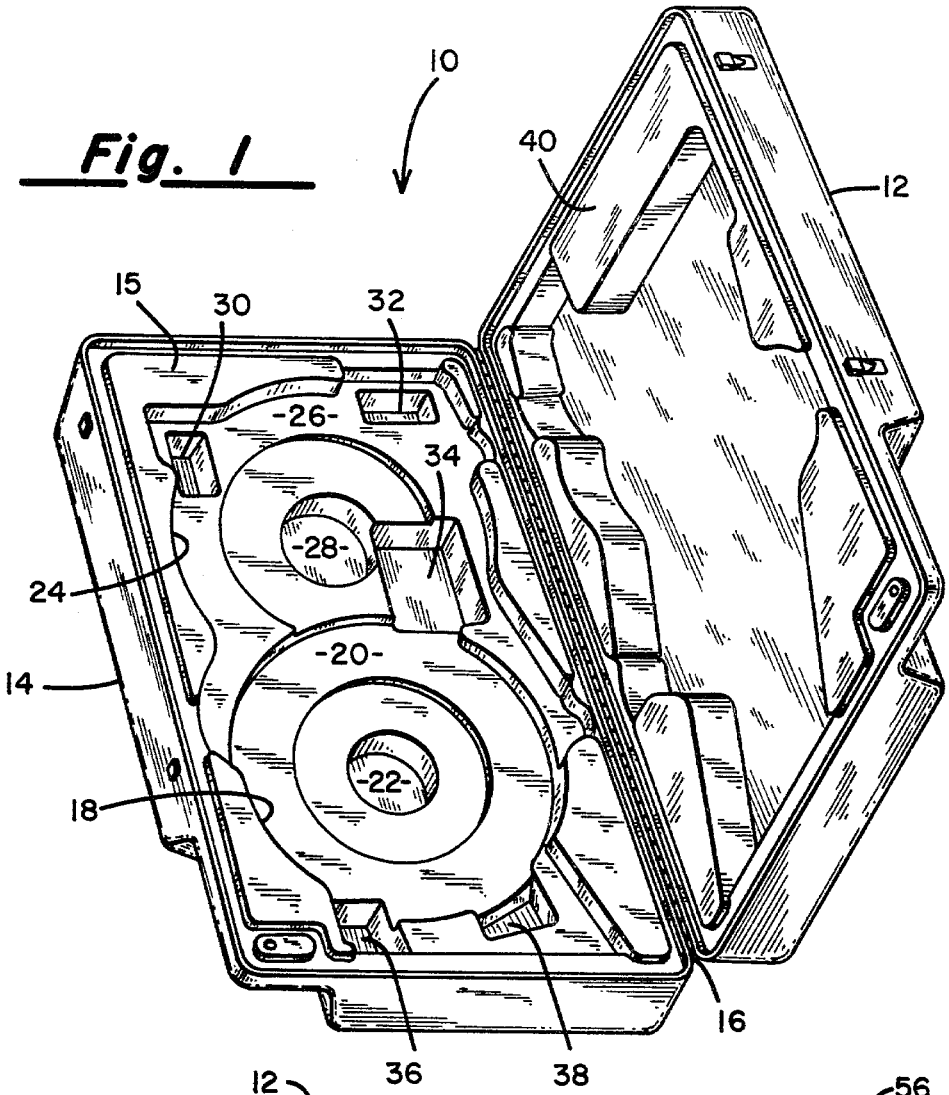
FIG. 1 shows the invention in isometric view.

Referring first to FIG. 1, the invention is shown in isometric view in opened position. A container 10 having a base portion 14 and a cover portion 12 is hinged along the line 16. The outside surface of cover 12 and base 14 is preferably constructed of plastic material having shock and temperature resistant characteristics. A material which is suitable for this purpose is acrylonitrile buladiene styrene (ABS). Such a material has the further advantage that it can be molded with a relatively high gloss surface in many different colors. The interior surface 15 of base 14 is molded into a plurality of contours as will hereinafter be described.

A first circular recess or well 18 is formed in interior surface 15 and sized to seat a rear bicycle wheel. Well 18 has a tapered or beveled surface portion 20 which tapers downwardly toward the center 22. Beveled surface 20 accommodates the bicycle spokes and permits the wheel to be supportable about its outer rim and tire parimeter. The center well 22 is sized to hold the rear hub and free wheel gear 23. The bottom of center well 22 may be lined with resilient foam material for further protection to the wheel components.

A second circular well 24 is sized to accept a front bicycle wheel. Well 24 is constructed at a higher elevational level than well 18, and is overlapping well 18 in its outer circumference. Well 24 has a beveled or tapered surface portion 26 which accommodates the spokes of the front wheel and permits the front wheel to be supported around its tire periphery. Center well 28 accommodates the front wheel hub, and the bottom surface of well 28 may be lined with resilient foam material for further protection. A recessed well 30 is provided for storage of bicycle pedals.

Handlebar wells 32 and 34 are provided for accepting the ends of handlebars. Well 34 is made particularly wide in order to accommodate handlebars of varying widths. Derailleur well 36 is provided to accept the rear derailleur mechanism attached to the bicycle frame and to store the same without injury. A well 38 has provided for miscellaneous spare parts. Further recesses may also be provided for retaining tools, supplies, and other devices.

The interior surface 40 of cover 12 is contoured essentially into two levels. A top level is contoured into irregular shapes to mate against similar raised levels of surface 15. The entire center portion of surface 40 is recessed to accommodate a bicycle frame and other projecting parts of a bicycle. The recessed portion of surface 40 may be lined with a resilient foam material to increase the protective qualities of container 10.

Figure 2:
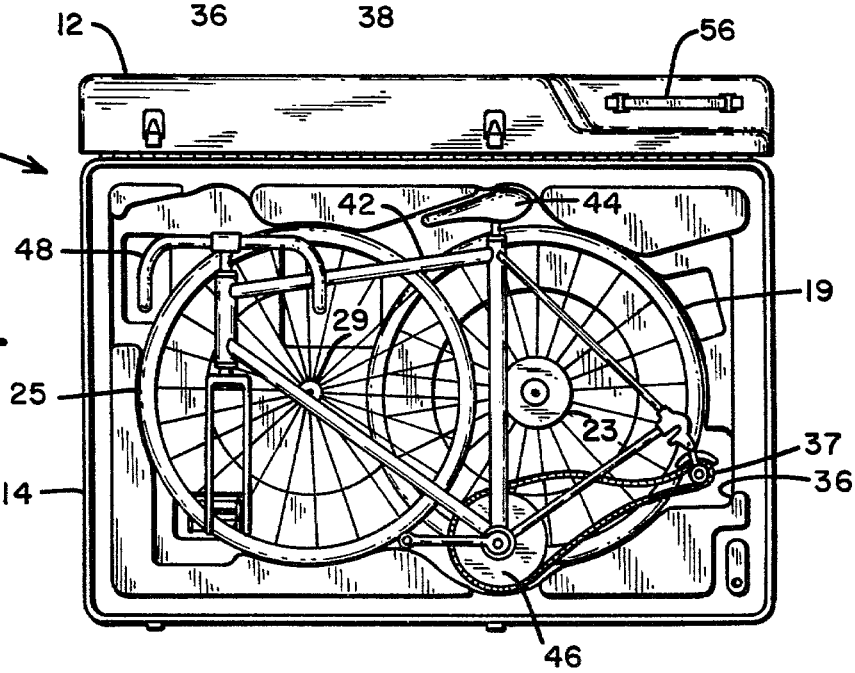
FIG. 2 shows a top view of the invention having a bicycle stored therein.

FIG. 2 shows a top view of container 10 with a bicycle installed therein. Rear wheel 19 is seated in recess or well 18, with wheel hub 23 in center well 22. Front wheel 25 is seated in well 24 with its hub 29 in center well 28. Frame 42 rests atop wheels 19 and 25, with the frame members partially being supported by the tires of the wheels. Seat 44 is supported by a portion of surface 15, and chain wheel 46 is similarly supported. Rear derailleur 37 is seated in derailleur well 36, and handlebar 48 has its ends inserted into wells 32 and 34 respectively. Seat 44 may have to be removed from some bicycles, especially bicycles having larger than normal frames. The typical bicycle frame is a 21½" frame, and the preferred embodiment of the invention is sized to accommodate this size frame. For larger frame bicycles, the seat and seat post may be removed and stored elsewhere in the container. Several open regions within the container are available for storing the seat and seat post.

Figure 3:
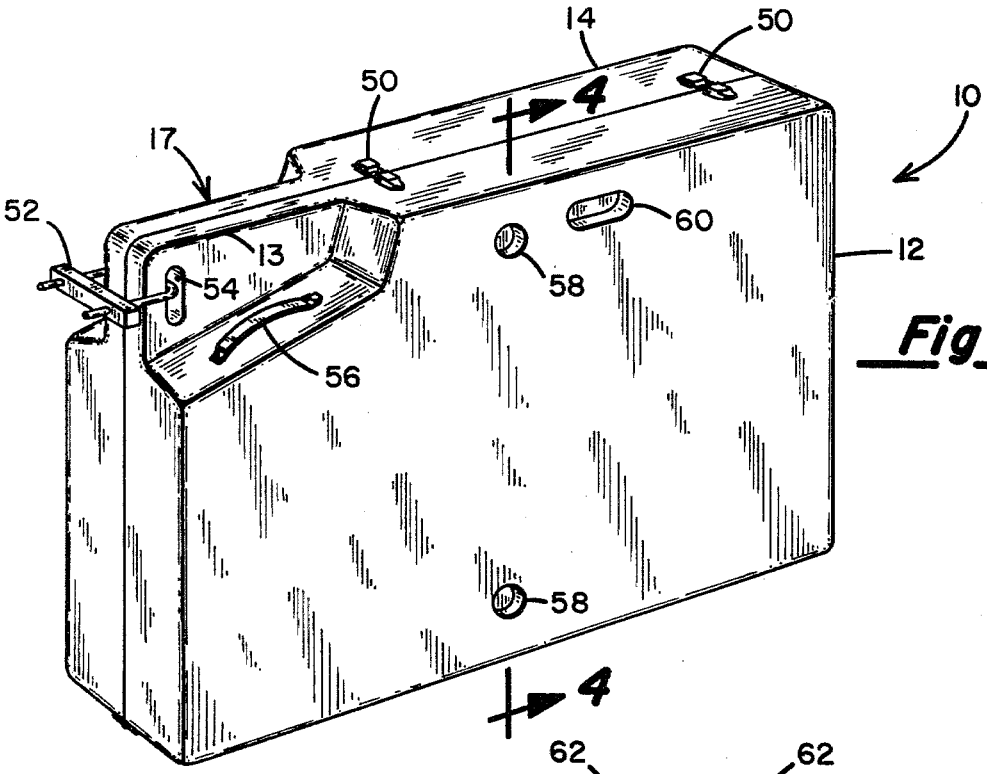
FIG. 3 shows an isometric view of the invention in closed position.

FIG. 3 shows container 10 in closed position; a plurality of latches 50 may be used to secure closure between cover 12 and base 14. A recessed corner 17 on base 14, and a similar recessed corner 13 on cover 12 are provided to form an end section of reduced width. An opening 54 extends through both sides of these recesses, and a lock 52 may be inserted therethrough. Lock 52 may be of the type formed as a U-lock, to ensure positively that cover 12 cannot be opened from base 14.

One or more handle straps 56 may be provided to facilitate carrying of container 10. Similarly, a number of recesses 60 may be provided for hand grips to facilitate carrying. One or more further recesses 58 may be provided to facilitate stacking of a plurality of containers 10. Recesses 58 are sized to snugly accept a ball such as a tennis ball, which when inserted into a recess 58 projects therefrom for seating in an adjacent similar recess of an adjacent container. In this manner, a plurality of containers 10 may be stacked with interlocking connections.

Figure 4:
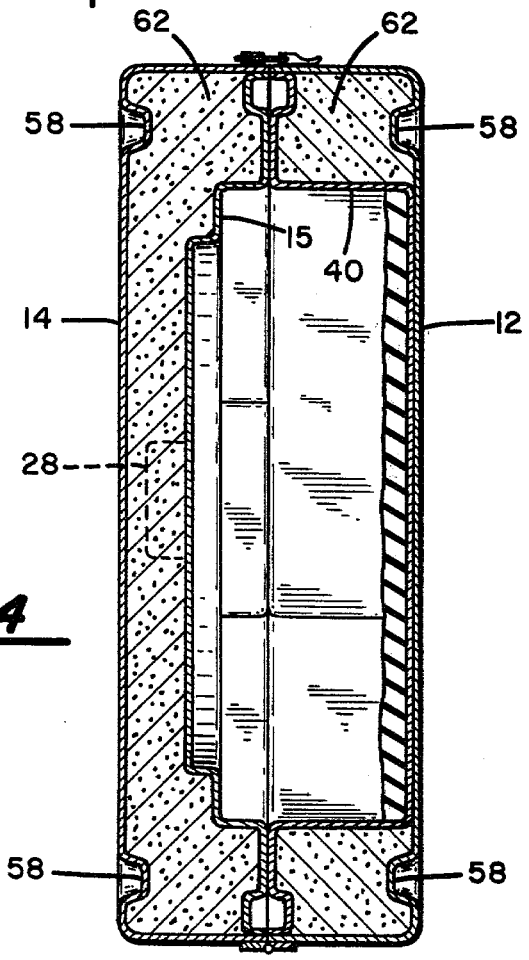
FIG. 4 shows a cross-sectional view of the invention taken along the lines 4—4 of FIG. 3.

FIG. 4 shows a preferred embodiment of the invention in cross-sectional view, taken along the lines 4—4 of FIG. 3. The region between the interior and exterior surfaces of base 14 is filled with a polyurethane foam material. This material may be applied into the interior recess through a temporary opening, and it quickly sets to form a semiresilient protective layer. Similarly, the interior recesses between the exterior and interior surface of cover 12 are filled with a similar foam material. The interior surface of cover 12 may be extended into mating and abutting facing relationship against its exterior surface as shown in FIG. 4, or may be made of shallower dimension as is preferred. The respective surface contours, and shapes and depths of the various wells may also be modified to accommodate particular preferences, but it is presumed that the design described herein is amenable to the transport and storage of bicycles of a great variety of sizes and shapes. All of the recesses are made large enough to accommodate variations in dimensional sizes, and the circular recesses are made large enough to accept the largest commonly used bicycle wheel. Of course, the recessed positions may be interchangeably located so long as all of the components of a bicycle fit as described generally herein.

In an alternative embodiment, the cross section of FIG. 4 may be developed by using die cut sections of polyurethane foam material, applied against the inside surfaces of cover 12 and base 14. An advantage of using die cut material to form the interior recesses and contours is that precise forming is possible, to accommodate the exact shape of a particular bicycle model. For example, a very expensive bicycle or a custom made bicycle could be fitted into a die cut contour with great precision, the outer surface shape of the die cut material being fitted to the shape of cover 12 and base 14. In this manner, a single molded base and cover could be used to accommodate any particular bicycle size and style by merely utilizing a custom die cut interior foam packing for container 10.

In operation, container 10 is first unlatched and cover 12 is opened to expose the interior of the container. The bicycle to be stored therein is then partially disassembled according to the following steps. The rear wheel is removed from attachment to the bicycle frame, and the chain is disconnected from the respective gears. The rear wheel is seated into well 18, with the gear facing downward into center well 22. Next, the front wheel is removed from attachment to the bicycle frame and is seated into well 24. The bicycle pedals are then removed by unthreading them from the crank arm of chain wheel 46, and the pedals are stored into well 30. The frame and handlebars are then set into container 10 atop the wheels, and with the rear derailleur mechanism seated into well 36. A protective cover may be used to overlay the wheels prior to setting the frame into the container, to further ensure against scratching or other contact between the respective bicycle parts. When the frame is set into the container the front fork and handlebars are turned 90° so as to permit the handlbars to fit into wells 32 and 34. The handlebar fitting into well 34 is positioned between the spokes of the front wheel resting beneath it.

As has been hereinbefore stated, other and further wells may be provided for storage of tools, spare parts, and other equipment. After all of the bicycle components and other equipment have been stored according to the preceeding description, cover 12 is closed over base 14 and latches 50 are secured. A locking member may be inserted through opening 54 through base 14 and cover 12 to positively lock these members together and prevent unauthorized opening. The container may be carried by means of handles and recesses provided thereon and therein, or shoulder straps attached thereto, and may be stacked as has been hereinbefore described.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A container for the storage and transport of a disassembled bicycle, comprising:

(a) a first container section having an outer cover, an intermediate plastic foam filler and an inner formed surface contour, said surface contour having a lower level circular recess adapted for seating a first bicycle wheel and a higher level circular recess adapted for seating a second bicycle wheel in partial overlapping of said first wheel, and a plurality of further recesses for accepting further bicycle assemblies; and (b) a second container section having an outer cover, an intermediate plastic foam filler and an inner formed surface, whereby said second section may be closed over said first section.

2. The container of claim 1, wherein one of said plurality of further recesses is positioned to accept a bicycle rear derailleur.

3. the container of claim 2, further comprising raised shoulders positioned about said circular recesses, said raised shoulders positioned for supporting a bicycle frame member over said bicycle wheels.

4. The container of claim 3, wherein each of said circular recesses further comprises a surface tapering downward toward the center.

5. The container of claim 4, further comprising resilient foam material lining the lower surfaces of said recesses.

6. The container of claim 4, further comprising an opening through each of said container sections, said openings being in alignment when said second section is closed over said first section.

7. A container for the storage and transport of a bicycle, comprising:

(a) a first container section having an outer cover, an inner formed surface contour, and an intermediate resilient filler material, said inner surface contour having a circular recessed well at a first level, an overlapping circular recessed well at a second higher level, each of said recessed wells adapted for seating a bicycle wheel therein, and raised support shoulders spaced about said recessed wells for supporting a bicycle frame member;

(b) a second container section having an outer cover, an inner formed surface contour, and an intermediate resilient filler; and (c) means for interlocking said first and second container sections to form an enclosed container for said bicycle wheels and frame member.

8. The container of claim 17, wherein said first and second level recessed wells each further comprise a beveled surface contour recessed toward the center of said circular recessed well.

9. The container of claim 8, further comprising a third circular recess in the center of said first level recessed well, said third recess extending to a third lower level, and further comprising a fourth circular recess in the center of said second level recessed well, said fourth recess extending to a fourth lower level.

10. The container of claim 9, further comprising at least one additional recess in said first section inner surface contour, said recess extending to a lower level than said surface contour where said recess is located.

11. The container of claim 10, further comprising resilient material lining the lower level of said recesses.

12. The container of claim 11, further comprising resilient material lining the lower surface of said second section inner contour surface.

13. The container of claim 12, wherein said means for interlocking further comprises a hinge between and adjoining an edge of each of said sections.

14. The container of claim 13, wherein said means for interlocking further comprises openings through said first section section and said second section, said openings adapted for alignment and for insertion of a locking member therethrough.

15. The container of claim 14, further comprising additional recesses in the outer cover of said first section and in the outer cover of said second section, said additional recesses being in proximate alignment in each section when said sections are interlocked.

* * * * *